US008790115B2

(12) United States Patent
Ebner et al.

(10) Patent No.: US 8,790,115 B2
(45) Date of Patent: Jul. 29, 2014

(54) METHOD FOR PREHEATING ANNEALING PRODUCTS IN A HOOD-TYPE ANNEALING SYSTEM

(75) Inventors: Robert Ebner, Leonding (AT); Gerhard Denk, Leonding (AT); Heribert Lochner, Leonding (AT); Andreas Sauschlager, Leonding (AT)

(73) Assignee: Ebner Industrieofenbau Gesellschaft m.b.H., Leonding (AT)

( * ) Notice: Subject to any disclaimer, the term of this patent is extended or adjusted under 35 U.S.C. 154(b) by 355 days.

(21) Appl. No.: 13/257,637

(22) PCT Filed: Mar. 18, 2010

(86) PCT No.: PCT/AT2010/000082
§ 371 (c)(1),
(2), (4) Date: Sep. 20, 2011

(87) PCT Pub. No.: WO2010/108204
PCT Pub. Date: Sep. 30, 2010

(65) Prior Publication Data

US 2012/0009536 A1 Jan. 12, 2012

(30) Foreign Application Priority Data

Mar. 25, 2009 (AT) ..... 482/2009

(51) Int. Cl.
*F27B 5/02* (2006.01)

(52) U.S. Cl.
USPC ..... 432/207; 432/206; 432/212; 266/263

(58) Field of Classification Search
USPC ..... 432/9, 200, 148, 254.1, 254.2, 206, 432/207, 212; 266/262, 263, 264; 148/601, 148/606, 628
See application file for complete search history.

(56) References Cited

U.S. PATENT DOCUMENTS 1,546,532 A * 7/1925 Baily ..... 148/709
2,255,617 A * 9/1941 Hoak ..... 432/22
(Continued)

FOREIGN PATENT DOCUMENTS

DE 1 142 889 1/1963
DE 1 235 968 3/1967
(Continued)

OTHER PUBLICATIONS

International Search Report of PCT/AT2010/000082, Aug. 12, 2010.

*Primary Examiner* — Gregory A Wilson
(74) *Attorney, Agent, or Firm* — Collard & Roe, P.C.

(57) ABSTRACT

A method is described for preheating annealing goods in a hood-type annealing installation, comprising two annealing bases (1, 2) which accommodate the annealing goods (3, 4) under a protective cover (7, 8), with the annealing goods (3) to be subjected to a heat treatment under a protective cover (8) being preheated with the help of a gaseous heat carrier which is guided in a cycle between two protective covers (7, 8) and absorbs heat from annealing goods (4) which are heat-treated in a protective cover (7) and emits it to the annealing goods (3) to be preheated in the other protective cover (8). In order to avoid contaminations of the heat-treated annealing goods (4) it is proposed that the heat carrier flow guided in a cycle flows around the two protective covers (7, 8) on the outside, whereas a protective gas is circulated within the protective covers (7, 8).

7 Claims, 3 Drawing Sheets

(56) References Cited

U.S. PATENT DOCUMENTS

| | | | | | |
|---|---|---|---|---|---|
| 2,432,239 | A | * | 12/1947 | Hoak | 432/207 |
| 2,721,734 | A | * | 10/1955 | Grunewald et al. | 432/81 |
| 3,063,878 | A | * | 11/1962 | Wilson | 148/559 |
| 3,816,901 | A | * | 6/1974 | Camacho et al. | 29/401.1 |
| 3,832,129 | A | * | 8/1974 | Derbyshire et al. | 432/77 |
| 3,972,513 | A | * | 8/1976 | Mobius et al. | 266/130 |
| 3,980,467 | A | * | 9/1976 | Camacho et al. | 75/10.19 |
| 4,142,712 | A | * | 3/1979 | Hemsath et al. | 266/44 |
| 4,480,822 | A | * | 11/1984 | Mauratelli | 266/256 |
| 4,502,671 | A | * | 3/1985 | Omura | 266/256 |
| 4,544,142 | A | * | 10/1985 | Yoshida et al. | 266/252 |
| 4,579,319 | A | * | 4/1986 | Sasaki | 266/252 |
| 4,860,999 | A | * | 8/1989 | Ritter et al. | 266/103 |
| 5,025,129 | A | * | 6/1991 | Miller et al. | 219/201 |
| 5,388,809 | A | * | 2/1995 | Hemsath | 266/80 |
| 5,730,930 | A | * | 3/1998 | Velten et al. | 266/44 |
| 5,961,322 | A | * | 10/1999 | Coble | 432/238 |
| 7,427,375 | B1 | * | 9/2008 | Cushman | 266/252 |
| 7,520,746 | B1 | * | 4/2009 | Johnston et al. | 432/128 |

FOREIGN PATENT DOCUMENTS

| | | |
|---|---|---|
| DE | 33 35 284 | 4/1985 |
| GB | 497480 | 12/1938 |
| SU | 1 261 966 | 10/1986 |
| SU | 1 261 966 A1 | 10/1986 |
| WO | WO 85/01519 | 4/1985 |

* cited by examiner

METHOD FOR PREHEATING ANNEALING PRODUCTS IN A HOOD-TYPE ANNEALING SYSTEM

CROSS REFERENCE TO RELATED APPLICATIONS

This application is the National Stage of PCT/AT2010/000082 filed on Mar. 18, 2010, which claims priority under 35 U.S.C. §119 of Austrian Application No. A 482/2009 filed on Mar. 25, 2009, the disclosure of which is incorporated by reference. The international application under POT article 21(2) was not published in English.

FIELD OF THE INVENTION

The invention relates to a method for preheating annealing goods in a hood-type annealing installation, comprising two annealing bases which accommodate the annealing goods under a protective cover, with the annealing goods to be subjected to a heat treatment under a protective cover being preheated with the help of a gaseous heat carrier which is guided in a cycle between two protective covers and absorbs heat from annealing goods which are heat-treated in a protective cover and emits it to the annealing goods to be preheated in the other protective cover.

DESCRIPTION OF THE PRIOR ART

Hood-type annealing installations are used for subjecting annealing goods such as hot-formed or cold-formed strips or wires under protective gas to a heat treatment. For this purpose, the annealing goods accommodated by an annealing base are heated under a protective cover in a protective-gas atmosphere, which occurs with the help of a heating cover which is placed over the protective cover which is heated electrically or via gas burners, so that the annealing goods are heated to treatment temperature substantially by radiation heat on the outside wall of the protective cover and convection from the inside wall of the protective cover. During the heat treatment, the lubricant residues adhering to the annealing goods will evaporate and be removed from the protective cover with a partial stream of the protective gas. The annealing goods are cooled again after the heat treatment. In order to enable the utilization of a part of the heat obtained during the cooling of the annealing goods for preheating the annealing goods that yet need to be subjected to a heat treatment, it is known in hood-type annealing installations with at least two annealing bases to provide a flow connection for recirculating a gaseous heat carrier between the protective covers of two annealing bases which on the one hand already carry hot annealing goods that have already been subjected to heat treatment and on the other hand cold annealing goods that will be subjected to such a treatment, so that the heat absorbed from the heat carrier within the protective cover with the hot annealing goods can be used for preheating the cold annealing goods in the other protective cover, which comes with the disadvantage however that as a result of the cycle guidance of the heat carrier there is a likelihood that lubricants which evaporate during the preheating of the cold annealing goods will contaminate the heat-treated annealing goods that have already been purified from lubricants. If the direct contact of the hot and cold protective gas is to be avoided, a complex additional gas/gas heat exchange is necessary. In both cases, the protective gas flows need to be guided through large openings in the base, leading to high safety risks.

SUMMARY OF THE INVENTION

The invention is thus based on the object of providing a method of the kind mentioned above for preheating annealing goods in a hood-type annealing installation in such a way that the likelihood of contamination of the annealing goods that have already been subjected to heat treatment can be excluded.

This object is achieved by the invention in such a way that the heat carrier flow guided in a cycle flows around the two protective covers on the outside, whereas a protective gas is circulated within the protective covers, so that no lead-through openings in the base are necessary, among other things.

Since as a result of this measure the heat carrier guided in the cycle does not come into contact with the annealing goods, no impurities can be transferred from the cold to the hot annealing goods via this heat carrier flow. The heat transfer occurs via the protective covers, in which protective gas is circulated for heat transport. As a result of this fact, the heat carrier itself can consist of air without having to fear any formation of oxides on the surface of the annealing goods by the air oxygen.

Different hood-type annealing installations can be used for performing such a method for preheating annealing goods. One possibility is provided in a hood-type annealing installation with two annealing bases receiving the annealing goods under a protective cover, with circulating devices for a protective gas associated with the protective covers and a cycle guidance for a gaseous heat carrier between the two protective covers in that the cycle guidance for the heat carrier is provided with one heat-insulated enclosure each which enclose the two protective covers at a distance, and a flow connection is provided between the two enclosures for the cycle guidance of the heat carrier. The heat carrier therefore flows between the two enclosures in a cycle, with the same absorbing heat over the protective cover with the hot annealing goods and emitting the heat via the other protective hood to the cold annealing goods until a temperature balance occurs. The hot annealing goods will then be cooled in a conventional manner with a cooling cover, whereas the preheated annealing goods must be heated to the respective treatment temperature in that the enclosure will be replaced by a heating cover.

A further embodiment of a hood-type annealing installation for preheating the annealing goods is obtained when the cycle guidance for the heat carrier comprises a heat-insulated enclosure which jointly encloses the two protective covers and comprises at least one fan for the cycle guidance of the heat carrier. The heat carrier which is circulated in this common enclosure ensures a temperature balance between the protective covers with the hot and cold annealing material, with the cycle guidance of the protective gas in the protective covers ensuring a heat transfer from and to the annealing goods. The heat carrier must flow in a respective manner against the protective covers in order to improve the heat transfer. For this purpose, guide walls for cycle guidance of the heat carrier can be provided within the enclosure.

Finally, the heating cover which is placed over the protective cover and necessary for its heating can be used for preheating the annealing goods when the cycle guidance for the heat carrier comprises a heat-insulated enclosure which encloses the goods to be preheated at a distance and which is flow-connected with the heating cover placed over the protective cover with the heat-treated annealing goods for cycle guidance of the heat carrier. In this case, the protective cover which accommodates the annealing goods to be preheated merely needs to be provided with a separate enclosure because the heating cover for the already heat-treated annealing goods can be used in an advantageous manner for the guidance of the heat carrier. With a respective flow connection between the heating cover and the enclosure for the protective cover of the annealing goods to be preheated, the heat carrier can be guided in a simple manner in a cycle. The heat transfer conditions between the heat carrier and the protective cover within the enclosure can be optimized by means of respective guide devices which are provided between the enclosure and the protective cover.

Simplified conditions for the alternating preheating and cooling of annealing goods placed on the annealing bases are obtained when the heat-insulated enclosure is arranged in the same manner as the heating cover. The direction of flow of the heat carrier can preferably be reversible.

BRIEF DESCRIPTION OF THE DRAWINGS

The method in accordance with the invention for preheating annealing goods in a hood-type annealing installation is described in closer detail by reference to the drawings, wherein.

DESCRIPTION OF THE PREFERRED EMBODIMENT

Figure 1:
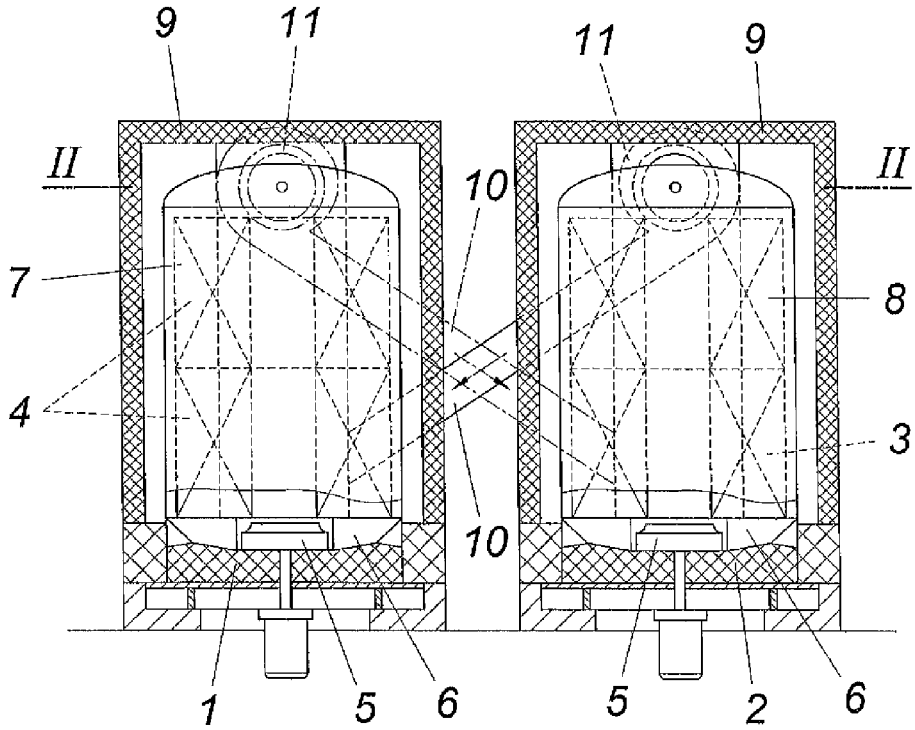
FIG. 1 shows a schematic vertical sectional view of a hood-type annealing installation in accordance with the invention for preheating annealing goods.
Figure 2:
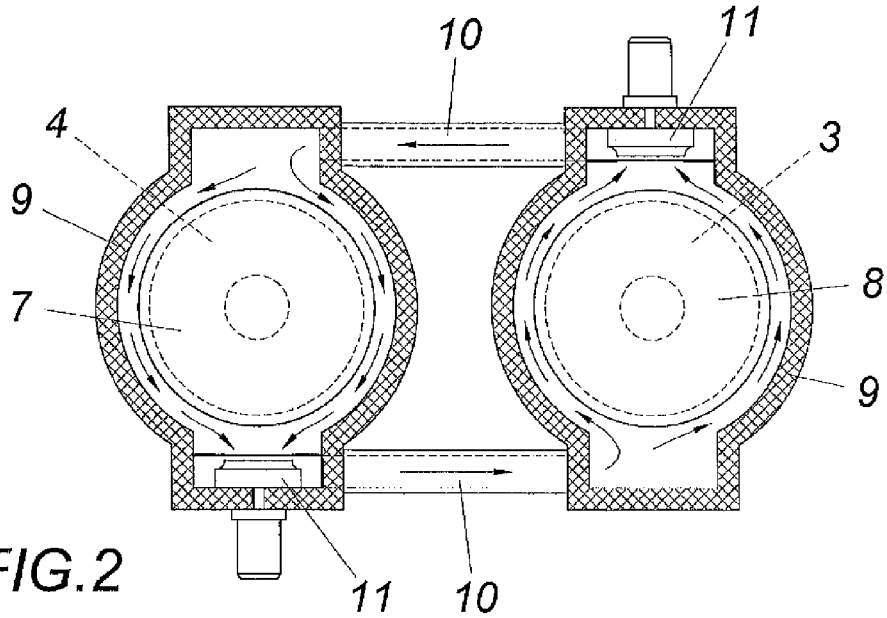
FIG. 2 shows this hood-type annealing installation in a sectional view along the line II-II in FIG. 1.

In accordance with the embodiment according to FIGS. 1 and 2, the hood-type annealing installation comprises two annealing bases 1 and 2 for accommodating annealing goods 3, 4. The annealing bases 1, 2 are provided with a blower 5 and a guide device 6 for the blower 5 for circulating a protective gas within a protective cover 7, 8 which encloses the annealing goods 3, 4. A heating cover which can be heated electrically or with the help of gas burners is placed in a conventional manner over the protective covers 7, 8 for the heat treatment of the annealing goods 3, 4. This is not shown for reasons of clarity of the illustration. The protective covers 7, 8 are each provided according to the illustrated method with a thermally insulated enclosure 9 for the purpose of preheating annealing goods to be subjected to heat treatment with the help of the heat of annealing goods that have already been heat-treated, with the arrangement being made in such a way that the two enclosures 9 are connected with each other by flow channels 10 in order to guide a gaseous heat carrier in a cycle between the two enclosures 9, as is shown especially in FIG. 2. The gaseous heat carrier, which is preferably air, is made to flow in a circulatory manner with the help of fans 11, in the region of which the heat carriers flow around the protective covers 7 and 8 for absorbing and emitting heat.

After the heat treatment of the annealing goods 4 within the protective cover 7, the heating cover used for this purpose is removed and replaced by the heat-insulated enclosure 9. The cold annealing goods 3 which are received by the annealing base 2 are to be preheated before use of a heating cover, which occurs with the help of the heat of the already heat-treated hot annealing goods 4. For this purpose, the protective cover 8 which accommodates the cold annealing goods 3 is provided with a enclosure 9, so that the heated heat carrier is conveyed via fan 11 from the enclosure 9 for the protective cover 7 with the hot annealing goods 4 to the enclosure 9 for the protective cover 8 with the cold annealing goods 3. Since there is simultaneously a conveyance of heat via the protective covers 7, 8 between the protective gas and the heat carrier via the fan 5 for circulating a protective gas within the protective covers 7 and 8, the heat removed from the hot annealing goods 4 is supplied to the cold annealing goods with the help of the cycle guidance of the heat carrier and the annealing goods are preheated accordingly until the temperature in the two enclosures 9 is substantially balanced. In order to continue the cooling of the heat-treated annealing goods 4, the cycle guidance of the heat carrier must be interrupted, with fresh air being drawn into the enclosure 9 for the continued cooling of the annealing goods 4 or the cooling is continued in a conventional manner, in a cooling cover (not shown) with air or water. The heat treatment of the preheated annealing goods 3 is continued by the exchange of the enclosure 9 by a heating cover, with the help of which the preheated annealing goods 3 are further heated to the necessary treatment temperature. After the heat treatment of annealing goods 3, their heat can be used again for preheating cold annealing goods, which is then subjected to analogous preheating on the annealing base 1.

Figure 3:
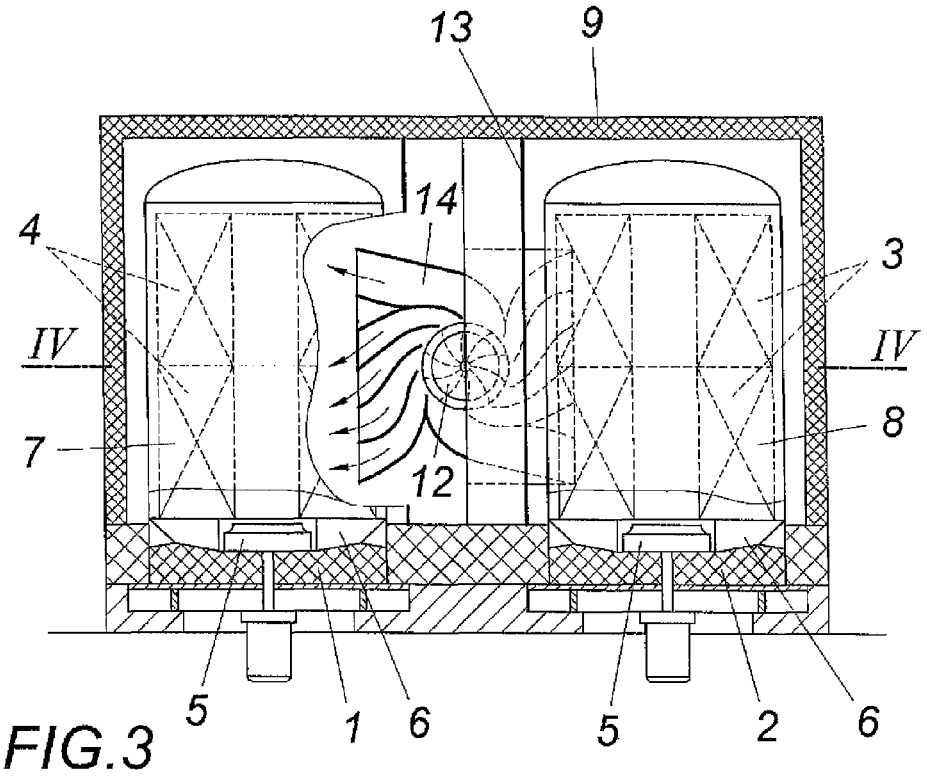
FIG. 3 shows an illustration corresponding to FIG. 1 of a modified hood-type annealing installation in accordance with the invention.
Figure 4:
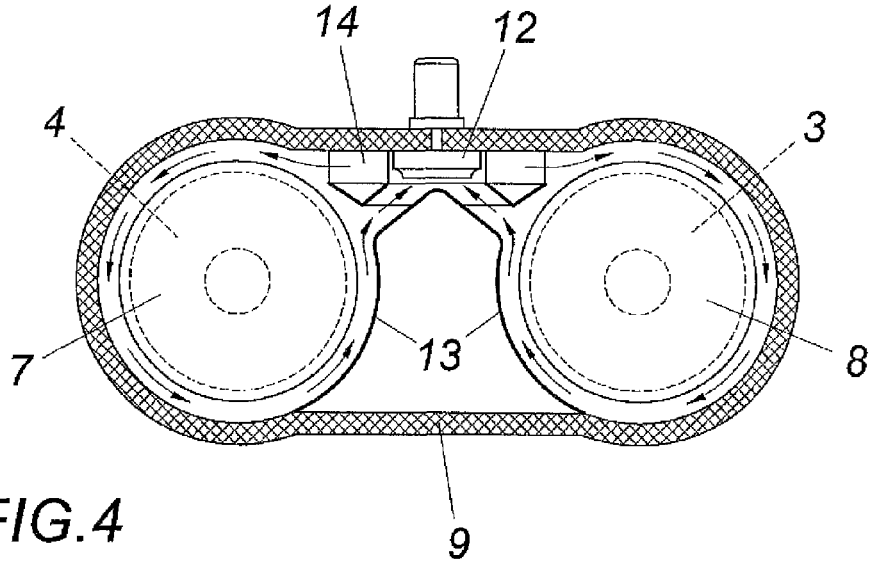
FIG. 4 shows the hood-type annealing installation according to FIG. 3 in a sectional view along the line IV-IV of FIG. 3.

The embodiment according to FIGS. 3 and 4 differs from the one according to FIGS. 1 and 2 substantially in such a way that a common heat-insulated enclosure 9 is provided for both protective covers 7, 8 of the annealing bases 1, 2, in which a gaseous heat carrier is made to circulate by means of at least one fan 12 in such a way that the heat carrier stream flows about the two protective covers 7 and 8 in a successive manner. Guide walls 13 for guiding the circulation of the heat carrier can be provided within the enclosure 9 for better guidance of the flow, which guide walls force the flow to flow about the protective covers 7 and 8, as is shown in FIG. 4. In order to obtain a respective division of the flow, the fan 12 can further be provided with a guide device 14 which ensures a division of the flow according to height. The preheating of the cold annealing goods 3 on the annealing base 2 within the protective cover 8 occurs in analogy to FIGS. 1 and 2, because the heat transferred from the hot annealing goods 4 which have already been subjected to a heat treatment via the circulated protective gas to the protective cover 7 and from the same to the heat carrier is supplied to the protective cover 8 for the annealing goods 3 to be heated and is transferred to the circulating protective gas within the protective cover 8 in order to preheat the annealing goods 3.

Figure 5:
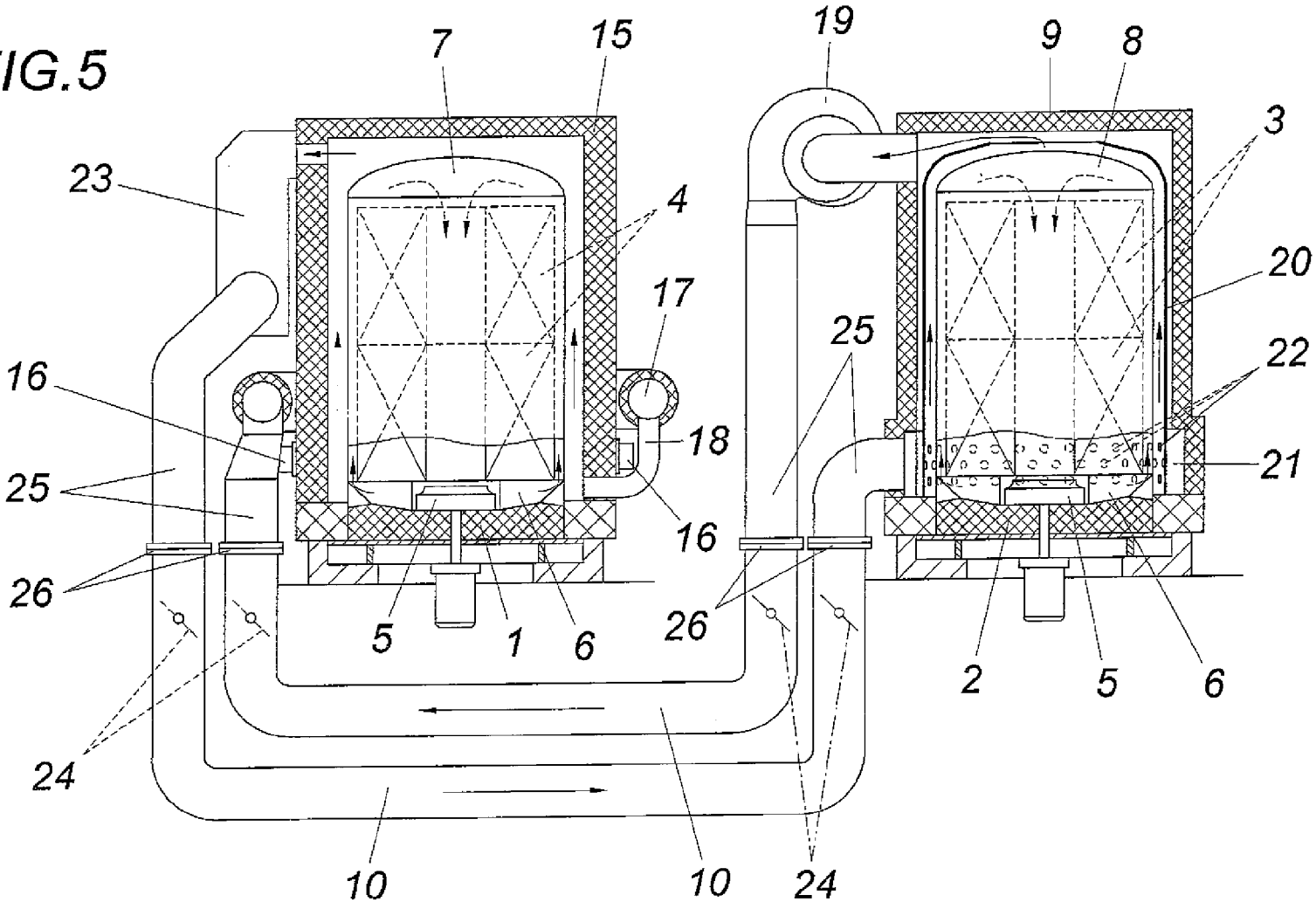
FIG. 5 shows a further embodiment of a hood-type annealing installation in accordance with the invention in a schematic vertical sectional view.

As is shown in FIG. 5, a heating cover 15 can fulfill the task of a enclosure 9 because it is only intended to ensure a flow of a heat carrier flowing about the protective cover 7 for the hot annealing goods 4 for absorbing the heat to be discharged from the hot annealing goods 4 via the circulation of a protective gas. The heating hood 15 which is provided with gas burners 16 or is electrically heatable is provided for this purpose with a ring line 17 which encloses the same and through which the heat carrier to be heated is introduced via stub lines 18 arranged over the circumference into the floor region of the heating cover 15 whose gas burners 16 are obviously cut off after the heat treatment of the annealing goods 4. The heat carrier flow which rises in the annular gap between the protective cover 7 and the heating cover 15 and which is thus heated via the protective hood is drawn in with the help of a suction fan 19 via a flow channel 10 into the enclosure 9 in order to heat the cold annealing goods 3 within the protective cover 8. An additional guide device 20 in the form of a jacket enclosing the protective cover 8 can be provided within the enclosure 9, which jacket is connected to the flow channel 10 via a ring channel 21, so that the heated heat carrier will flow about the protective cover 8 through pass-through openings 22 of the guide device 20 close to the floor in the annular space between the protective cover 8 and the guide device 20 and thus emits heat to the protective cover 8, so that this emitted heat can be transferred to the annealing goods 3 by the protective gas which is circulated within the protective cover 8. The heat carrier thus cooled is supplied to the heating cover 15 for heating via the suction fan 19 and a flow channel 10 between the suction fan 19 and the ring line 17. The recuperator 23 which is usually connected to the heating cover 15 and used for utilizing the sensible waste heat of the burner gases drawn off from the heating cover during the heat treatment of the annealing goods 4 is irrelevant in this connection. The circulatory flow of the heat carrier can be additionally controlled by control flaps 24 in the flow channels 10. In order to facilitate the connection of the heating cover 15 or the heat-insulated enclosure 9 to the flow channels 10, the connection pieces 25 can be connected with the flow channels 10 via respective couplings 26. According to the correct arrangement of these connection pieces, the heating cover 15 can also be positioned to the right and the enclosure 9 also to the left (changing cover).

It is understood that the heating cover 15 and the enclosure 9 can further accommodate the annealing goods to be heated or cooled in an alternating manner and can be arranged similarly, and the circulating device for the protective gas can be reversible.

The invention claimed is:

1. A method for preheating annealing goods in a hood-type annealing installation, the hood-type annealing installation comprising first and second annealing bases which accommodate the annealing goods under a first and second protective cover, respectively, with the annealing goods to be subjected to a heat treatment under the first and second protective covers being preheated with the help of a gaseous heat carrier which is guided in a cycle between the first and second protective covers and absorbs heat from annealing goods which are heat-treated in the first protective cover and emits the heat to the annealing goods to be preheated in the second protective cover, wherein the gaseous heat carrier flows around the first and second protective covers on the outside, and wherein a protective gas is circulated within the first and second protective covers.

2. A hood-type annealing installation comprising a first annealing base accommodating a first annealing good under a first protective cover, a second annealing base accommodating a second annealing good under a second protective cover, circulating devices for a protective gas associated with the first and second protective covers, and a cycle guidance for a gaseous heat carrier between the first and second protective covers, the cycle guidance comprising a first heat-insulated enclosure enclosing the first protective cover at a distance and a second heat-insulated enclosure enclosing the second protective cover at a distance, the first and second heat-insulated enclosures being flow-connected with each other for cycle guidance of the gaseous heat carrier.

3. A hood-type annealing installation comprising a first annealing base accommodating a first annealing good under a first protective cover, a second annealing bases accommodating a second annealing good under a second protective cover, circulating devices for a protective gas associated with the first and second protective covers, and a cycle guidance for a gaseous heat carrier between the first and second protective covers, the cycle guidance comprising a heat-insulated enclosure which encloses the first and second protective covers jointly and at least one fan for cycle guidance of the gaseous heat carrier.

4. The hood-type annealing installation according to claim 3, wherein guide walls for the cycle guidance of the gaseous heat carrier are provided within the heat-insulated enclosure.

5. A hood-type annealing installation comprising a first annealing base, a first protective cover, a second annealing base, a second protective cover, a heating cover placed over the first protective cover, and a cycle guidance for a gaseous heat carrier between the first and second protective covers, wherein the cycle guidance for the gaseous heat carrier comprises a heat-insulated enclosure which encloses the second protective cover and which is flow-connected with the heating cover for cycle guidance of the gaseous heat carrier.

6. The hood-type annealing furnace according to claim 5, wherein the heat-insulated enclosure is arranged like the heating cover.

7. The hood-type annealing furnace according to claim 5, wherein a guide device for the gaseous heat carrier is provided between the heat-insulated enclosure and the second protective cover.

* * * * *